US007674491B2

(12) United States Patent
Pool et al.

(10) Patent No.: US 7,674,491 B2
(45) Date of Patent: Mar. 9, 2010

(54) METHOD FOR EVACUATING AIR FROM FLEXIBLE PACKAGES

(75) Inventors: James H. Pool, Lake Forest, CA (US); Eric Paul Plourde, Homewood, IL (US)

(73) Assignee: Illinois Tool Works Inc., Chicago, IL (US)

( * ) Notice: Subject to any disclaimer, the term of this patent is extended or adjusted under 35 U.S.C. 154(b) by 1290 days.

(21) Appl. No.: 10/998,243

(22) Filed: Nov. 24, 2004

(65) Prior Publication Data

US 2006/0110497 A1 May 25, 2006

(51) Int. Cl.
*C12C 1/027* (2006.01)

(52) U.S. Cl. ..... 426/404; 426/106; 53/405; 53/434; 53/451; 383/100

(58) Field of Classification Search ..... 426/118, 426/106, 128; 383/63, 5, 61, 102; 53/434, 53/405, 512, 410, 128.1, 451, 503, 55, 552, 53/64

See application file for complete search history.

(56) References Cited

U.S. PATENT DOCUMENTS 3,016,284 A * 1/1962 Trexler ..... 414/800
3,302,859 A * 2/1967 Perry ..... 383/103
4,532,652 A * 7/1985 Herrington ..... 383/103
4,715,805 A * 12/1987 Nasu ..... 425/504
5,014,493 A * 5/1991 West ..... 53/410
5,063,639 A 11/1991 Boeckmann et al. ..... 24/30.5 R
5,116,301 A * 5/1992 Robinson et al. ..... 493/215
5,142,970 A * 9/1992 ErkenBrack ..... 99/472
5,228,271 A * 7/1993 Wallace ..... 53/434
5,875,611 A * 3/1999 Plourde ..... 53/412
5,904,425 A * 5/1999 May ..... 383/203
5,911,508 A 6/1999 Dobreski et al. ..... 383/5
5,930,983 A * 8/1999 Terminella et al. ..... 53/436
6,010,244 A * 1/2000 Dobreski et al. ..... 383/63
6,044,621 A * 4/2000 Malin et al. ..... 53/412
6,101,685 A 8/2000 Archibald et al. ..... 24/30.5 R
6,120,817 A 9/2000 Archibald et al. ..... 426/106
6,126,975 A 10/2000 Archibald et al. ..... 426/106
6,132,780 A * 10/2000 Archibald et al. ..... 426/106
6,378,272 B1 4/2002 Archibald et al. ..... 53/412
RE39,505 E * 3/2007 Thomas et al. ..... 53/412

* cited by examiner

*Primary Examiner*—Drew E Becker
*Assistant Examiner*—Steven Leff
(74) *Attorney, Agent, or Firm*—Ostrager Chong Flaherty & Broitman P.C.

(57) ABSTRACT

A method of manufacture comprising the following steps: (a) making a vent hole in a package; (b) loading product into a receptacle of the package via an opening; (c) closing the opening; (d) placing an air-permeable layer of material over the vent hole; (e) squeezing the receptacle after steps (a) through (d) have been performed to force air out the vent hole; and (f) after step (e) has been performed, sealing the package so that air cannot enter the receptacle via the vent hole. In accordance with some embodiments, the vent hole is formed in the receptacle and sealed by means of an air-impermeable patch or by joining two walls of the receptacle together. In accordance with other embodiments, the vent hole is formed in a zipper tape attached to the receptacle and various means can be used to seal the vent hole after air removal.

26 Claims, 8 Drawing Sheets

METHOD FOR EVACUATING AIR FROM FLEXIBLE PACKAGES

BACKGROUND OF THE INVENTION

The present invention relates to sealed packages. More specifically, the present invention relates to plastic bags filled with fine particulate matter, such as flour.

It is highly desirable to reduce the amount of air inside a package containing particulate matter. Air removal helps preserve the product and reduces the volume occupied by the package, thereby reducing the space required for shipping.

Plastic bags containing fine particulate matter are disclosed in U.S. Pat. No. 6,120,817 entitled "Container for Storing Fine Particles." The disclosed plastic bags have one or more macroscopic apertures or openings for exhausting entrapped air without loss of particulate matter when the bag is squeezed. This is accomplished by covering the apertures with layers of air-permeable, particulate-impermeable material that are attached to a surface of the bag.

U.S. Pat. No. 6,101,685 discloses plastic bags containing fine particulate matter and having a multiplicity of microscopic pores of a sufficient dimension to permit air to escape therethrough while preventing fine particles from escaping when the bag is squeezed. The microscopic pores can be formed using lasers before or after the bag is filled.

One known pouch for flour product has both panels laser perforated near the top and near the bottom. The employment of laser perforation increases the cost of the package.

There is a need for a resealable package that can be squeezed to remove entrapped air without loss of powder product and that can be manufactured at relatively low cost.

BRIEF DESCRIPTION OF THE INVENTION

The present invention is directed to methods and apparatus for removing entrapped air from packages without significant loss of particulate matter, such as flour, contained in the package. The invention is further directed to various bag constructions that allow entrapped air to be removed without significant loss of particulate matter contained therein.

One aspect of the invention is a method of manufacture comprising the following steps: (a) making a package having an opening and a first vent hole; (b) loading product into the package via the opening; (c) closing the opening; (d) placing a first air-permeable layer of material over the first vent hole; (e) squeezing the package after steps (a) through (d) have been performed to force air out the first vent hole; and (f) after step (e) has been performed, sealing the package so that air cannot enter the package via the first vent hole.

Another aspect of the invention is a VFFS machine comprising the following components disposed below the bag cut-off elevation: a piece of venting material; and a bag squeezer that is controlled to squeeze an unfinished bag disposed below the bag cut-off elevation while the piece of venting material is in a predetermined position relative to the unfinished bag.

A further aspect of the invention is a package comprising: first and second walls of packaging material joined or connected on three sides to form a receptacle having an interior volume and a mouth; product occupying at least a portion of the interior volume of the receptacle; a zipper tape comprising a web having a substantially U- or V-shaped profile with mutually confronting first and second sides, a first closure profile supported by the first side of the web, and a second closure profile supported by the second side of the web, the first and second closure profiles being interengageable with each other, the first side of the web being joined to a portion of the first wall in a first band-shaped zone of joinder, and the second side of the web being joined to a portion of the second wall in a second band-shaped zone of joinder, wherein the first side of the web comprises an aperture disposed above the first band-shaped zone of joinder; and a covering joined to the first side of the web, wherein the covering covers the aperture and provides a seal that prevents the passage of ambient air through the aperture.

Yet another aspect of the invention is a method of manufacture comprising the following steps: (a) forming a receptacle; (b) forming a vent hole in a wall of the receptacle; (c) placing an air-permeable layer of material over the vent hole; (d) filling the receptacle with product via an opening; (e) closing the opening after filling; (f) after the opening has been closed, squeezing the receptacle to force air out the vent hole; and (g) sealing the vent hole after filling so that air cannot enter the receptacle via the vent hole.

A further aspect of the invention is a method of manufacture comprising the following steps: (a) forming a vent hole in a zipper tape; (b) joining a first portion of the zipper tape to a first portion of a web of packaging material; (c) joining a second portion of the zipper tape to a second portion of the web; (d) joining third and fourth portions of the web to each other along a first line transverse to the zipper tape; (e) joining fifth and sixth portions of the web to each other along a second line transverse to the zipper tape; (f) placing an air-permeable layer of material over the vent hole; (g) filling a receptacle with product via an opening either after steps (d) and (e) but not step (c) have been performed or after steps (c) and (d) but not step (e) have been performed; (h) after steps (a) through (g) have been performed, squeezing the receptacle to force air out the vent hole; and (i) sealing the vent hole after squeezing so that air cannot enter the receptacle via the vent hole.

Yet another aspect of the invention is a method for expelling air from an interior volume of a flexible package, comprising the following steps: (a) forming a package having an open mouth and having a vent hole in an area above an elevation corresponding to a product fill level; (b) filling the open package with product up to the elevation via the open mouth; (c) sealing the mouth closed; (d) after steps (a) through (c) have been performed, squeezing the package to expel air from an interior volume of the package via the vent hole; and (e) hermetically sealing the vent hole from the interior volume so that ambient air cannot enter the interior volume via the vent hole.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Economical methods are disclosed herein by which air can be removed from inside a flexible package containing particulate matter to facilitate "reduced cube" shipping and/or help preserve the package contents. The packages are produced with one or more vent holes or vents that allow the air to escape when the filled package is squeezed. After the vent holes have been formed, a layer of air-permeable venting material is laid over the vent holes. The filled package can be squeezed, e.g., by feeding it into a converging tractor (i.e., conveyor) belt system. The tractor/conveyor belts could be flat/smooth, textured or ribbed, or could have discrete pockets to accept individual packages. When the package is squeezed by the belts, air is purged from the interior volume via the vent hole. The venting material allows air to pass through, but blocks the exodus of the particulate matter from inside the package. The venting material that covers the vent holes can be foam, metal or any other material capable of squeezing air out of the package while carrying the package along the conveyor. In the fully squeezed state (with residual air removed from the package interior), the package is then subjected to heat and pressure, e.g., by a band sealer, to form a hermetic seal that prevents the intake of ambient air via the vent hole or holes. The speed of the circulating belt system and the pressure applied to the package will depend on the package construction and the particular product contained therein. Alternatively, the squeezing and sealing operations can be performed by reciprocating devices that are activated during dwell times.

The system as generally described above may be designed into a vertical form-fill-seal (VFFS) vertical or a horizontal-form vertical-fill (HFVF) machine. In accordance with some embodiments, the vent hole (or holes) is (are) formed and the venting material is placed over the vent hole (or holes) before the package is filled. In this case, the vent hole (or holes) can be formed either before or after the package is formed. Alternatively, in accordance with other embodiments, the vent hole (or holes) are formed after the package has been filled, in which case the vent hole (or holes) is (are) preferably located above the product fill line. In the latter case, the filled packages can be evacuated by equipment (such as the aforementioned belt system) that is located downstream of the FFS machine. Depending on the system design, the post-filling air evacuation unit can be designed to also impart the vent holes.

Figure 1:
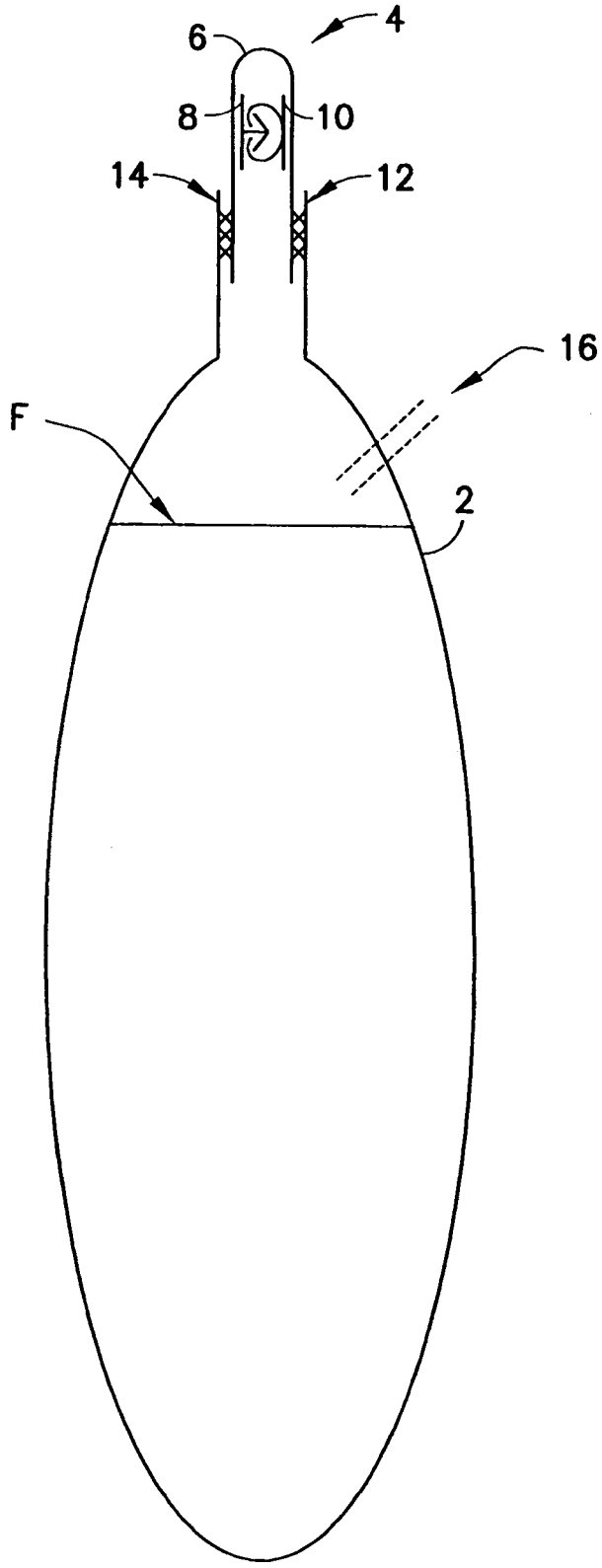
FIG. 1 is a drawing showing a sectional view of a package that has been manufactured on a form-fill-seal machine.

A method of evacuating air using a separate air evacuation unit disposed downstream of an FFS machine will be described with reference to FIGS. 1 and 2. FIG. 1 shows a sectional view of a typical reclosable package that can be made on either a HFVF or VFFS machine. The package comprises a web 2 of packaging material formed into a receptacle having an interior volume and a mouth, the mouth being closed by a zipper tape 4 that is attached to the web 2. The zipper tape 4 comprises a web 6 of thermoplastic material, which may be the same as or different than the packaging material of web 2. The zipper tape 4 is typically manufactured by extruding two mutually interengageable closure profiles 8 and 10 onto the web 6 in parallel spaced relationship while the latter is moving. The centerlines of the closure profiles are substantially equidistant from a centerline of the web 6, so that when the latter is folded in half, the closure profiles 8 and 10 can be brought into a state of interengagement, as seen in FIG. 1. The web 6 of the zipper tape 4 is typically attached to the web 2 by conventional conduction heat sealing using reciprocating mutually opposing heated sealing bars, with a separator plate (not shown) inserted between the mutually opposing marginal portions of the web 6 to prevent seal-through during the sealing operation. For example, a portion of one marginal portion of web 2 is joined to a portion of one marginal portion of web 6 in a first band-shaped zone of joinder constituting a first permanent seal 12, while a portion of another marginal portion of web 2 is joined to a portion of another marginal portion of web 6 in a second band-shaped zone of joinder constituting a second permanent seal 14.

The finished filled package comprises a receptacle having a zipper tape 4 across its mouth. The receptacle comprises generally rectangular front and rear walls that are sealed together at the sides. To gain access to the contents of the filled package, the user must tear off the top of the base web 6. To facilitate tearing off the top portion of the base web 6, the latter is preferably provided with a tear bead and a pair of lines of spaced perforations running the length of the web (not shown in FIG. 1). Furthermore, each line of perforations is preferably capped by a respective sealing stripe (again not shown), as taught in U.S. Pat. No. 5,063,639. The sealing stripe effectively seals the perforations while still leaving the line of weakened tear resistance provided by the perforations. The user is able to tear off the top of the zipper tape by grasping one end of the tear bead and pulling the grasped end toward the other end of the tear bead, causing the base web to tear along the perforated tear lines.

As previously noted, the package shown in FIG. 1 may be made on an HFVF or a VFFS machine. Such methods of manufacture are well known in the art, but exemplary methods will now be disclosed below (without reference to drawings) for the sake of completeness.

In the case of a VFFS machine, a web of packaging film )for forming the bag) is fed from a continuous supply roll, passed over a forming collar and wrapped around a fill tube to bring the mutually parallel edges of the bag web together to form a tube. The bag web passes through a gap between the forming collar and the top of the fill tube in a well-known manner. The marginal portions of the bag web do not lie against the outer surface of the fill tube, and instead are guided into mutually confronting vertical positions by guiding means. The fill tube has an upper funnel end through which product is discharged to fall downwardly into individual packages. At the same time that the bag web is being fed, the zipper tape is fed from a continuous coil on a supply reel or spool. The zipper tape is guided downwardly by a guide member in the form of a separator plate disposed between the mutually confronting marginal portions (i.e., fins) of the bag web. The separator plate is supported on the fill tube or integrally formed therewith. The guide separator plate is configured so that the marginal portions of zipper tape web are placed in mutually confronting relationship. The guiding means for the bag web guide the fins of the bag web to positions outside and overlapping with the marginal portions of the zipper tape web. The zones of overlap on opposing sides of the separator plate pass through respective gaps between the separator plate and a pair of mutually opposing vertical seal bars. Within the zone of overlap, opposing portions of the zipper tape web are joined to opposing portions of the fins of the bag web in respective band-shaped zones of joinder (as indicated by items 12 and 14 in FIG. 1) when a pair of vertical sealing bars are heated and placed in their extended positions. In their extended positions, the vertical sealing bars soften or melt the thermoplastic material of one or both webs, following which the softened or molten material fuses upon cooling to form the permanent heat seals. The bag web is advanced intermittently in increments of advancement equal to the width of a package to be formed. Typically, the bag web is pulled downwardly by drive belts that bear against the web and the fill tube. The cross-sealing bars are first brought together against a portion of the tubular film at a location where the film portion has descended below the lower end of the fill tube in order to form a pair of cross seals that join mutually opposing band-shaped portions of the bag web. One cross seal closes an already filled pocket, while the other cross seal forms the bottom of the next pocket, so that as product is dropped through the fill tube, that product is retained within the latter pocket. Essentially simultaneously with cross sealing by the sealing bars, a cutting knife is moved across the bag web (at an elevation between the spaced-apart cross seals) to sever an individual previously filled package from the work in process. The finished package lands on a take-off belt, which conveys the package to an air evacuation unit.

In the case of a horizontal-form vertical-fill (HFVF) machine (also not shown in FIGS. 1 and 2), a bag web is unwound from a roll and fed in a machine direction. The bag web may be advanced one package increment or width at regular intervals of time. A zipper tape is unwound from a spool and guided to a position whereat a marginal portion of one side of the base web of one section of the zipper tape overlies a marginal portion of a corresponding section of the bag web. That side of the zipper tape web is then heat sealed (e.g., using a pair of horizontal sealing bars, one of which is heated) to the bag web to form one of the permanent seals joining the zipper tape to the bag web. Then the bag web is folded along a centerline using a folding board and guide rollers, so that the other marginal portion of the same section of bag web overlaps with a marginal portion of the other side of the base web of the joined section of zipper tape. At the next station, the two sides of the folded bag web are joined to each other along spaced transverse lines, e.g., by conventional heat sealing using reciprocatable vertical sealing bars, one or both of the vertical sealing bars being heated. The heated sealing bar applies heat in a band-shaped zone having a centerline that is oriented substantially perpendicular to the zipper tape. When the web material cools, it fuses to form a cross seal. Successive cross seals, in combination with the fold at the bottom of the folded bag web, form a respective pocket that is not sealed at the top. Each pocket is then opened to allow the pocket to be loaded with product, such as particulate matter, by means of a filling device, such as a funnel. The pocket may be opened by conventional means, such as a pair of reciprocatable vacuum cups. To open the mouth of the pocket, first the vacuum cups are extended, then suction is provided to the cups. The vacuum cups are then retracted while suction is being applied. The suction holds respective portions of the folded sides of the bag web against the vacuum cups as the latter are retracted, causing the mouth of the pocket to open. Product from the funnel is dropped through the opening between one side of the bag web (not attached to the zipper tape) and the zipper tape attached to the other side of the bag web until the interior volume of the pocket is filled to a desired level F (see FIG. 1), referred to herein as the "product fill line".

After product has been loaded into a pocket, the top of the pocket is released from its fully open state by turning off the suction to the vacuum cups to release the two sides of the folded bag web. The filled pocket is then advanced to another sealing station where the confronting portion of the unattached marginal portion of the bag web is joined to the unattached side of the zipper tape web. This can be accomplished, e.g., by conventional heat sealing using a reciprocatable horizontal heated sealing bars. The horizontal sealing bar in its extended position will press the unattached marginal portion of the bag web against the marginal portion of the unattached side of the zipper tape web, producing a band-shaped zone of zipper tape/bag web joinder after the melted or softened thermoplastic material of the zipper and/or bag web has fused. At this juncture, the filled pocket is a sealed enclosure.

Thereafter each cross seal is cut, e.g., along a centerline, by a cutting instrument, such as a blade, to sever a filled package from the remaining work in process. Optionally, a conveyor belt placed below the filled pocket can be used to move the filled pockets forward to the cutting station. The finished package lands on a take-off belt, which conveys the package to an air evacuation unit.

One embodiment of an air evacuation unit suitable for removing air from filled packages being fed from a FFS machine performs three basic operations. First, at least one vent hole 16 (indicated by a pair of parallel dashed lines in FIG. 1) is formed in the package at an elevation above the product fill line F. The vent hole 16 can be punched in a corner of the package, at a location near but removed from the side seal.

Figure 2:
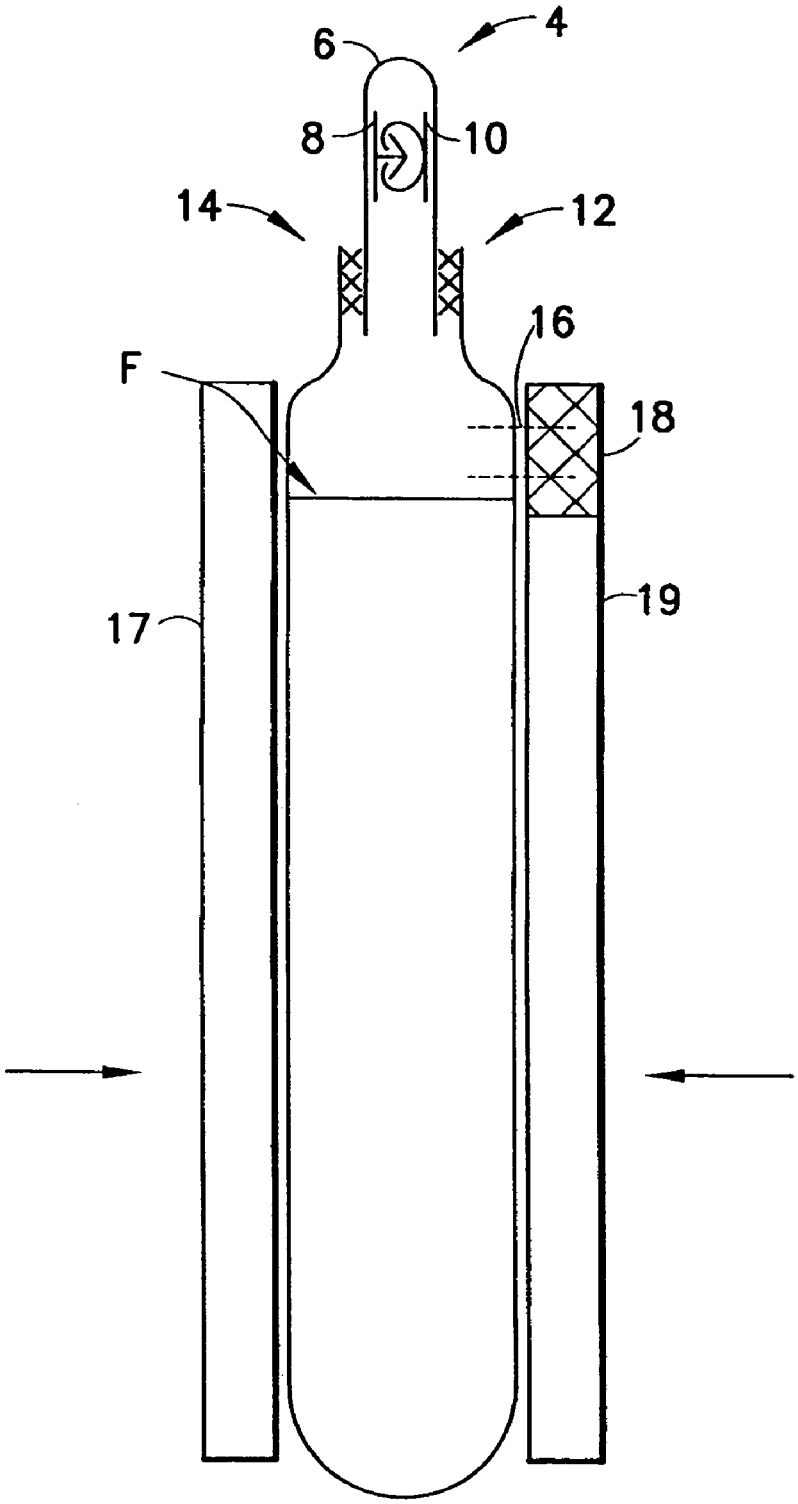
FIG. 2 is a drawing showing the package of FIG. 1 having air squeezed out by an air evacuation unit in accordance with one embodiment of the invention.

In the second operation, the filled package is squeezed from both sides (indicated by oppositely directed arrows in FIG. 2), e.g., by circulating belts or reciprocating plates, generally indicated by the structures designated by numerals 17 and 19 in FIG. 2. [In the case of circulating belts, items 17 and 19 represent only the contacting portion of the circulating belts, and the axes of the belt-supporting rollers would be oriented perpendicular to the opposing arrows in FIG. 2 and parallel to the plane of the paper.] Alternatively, a roller cylinder could be utilized. Whether structure 19 is a circulating belt or a reciprocating platen, it comprises a portion 18 made of venting material that is positioned to overlie the vent hole 16. As used herein, the term "venting material" means a material that is permeable to air, but impermeable to the particulate matter with which the package is filled. This arrangement allows air to be squeezed out of the interior volume of the package without the exodus of product.

In a third operation (not shown in FIG. 2), the vent hole (or holes) is (are) sealed, e.g., by a circulating band sealer or a reciprocating sealing bar, after the interior volume of the package has had excess air removed. The result is a hermetically sealed package that has reduced volume, which in turn reduces shipping and storage costs. The removal of excess air also helps to preserve the packaged product.

Figure 3:
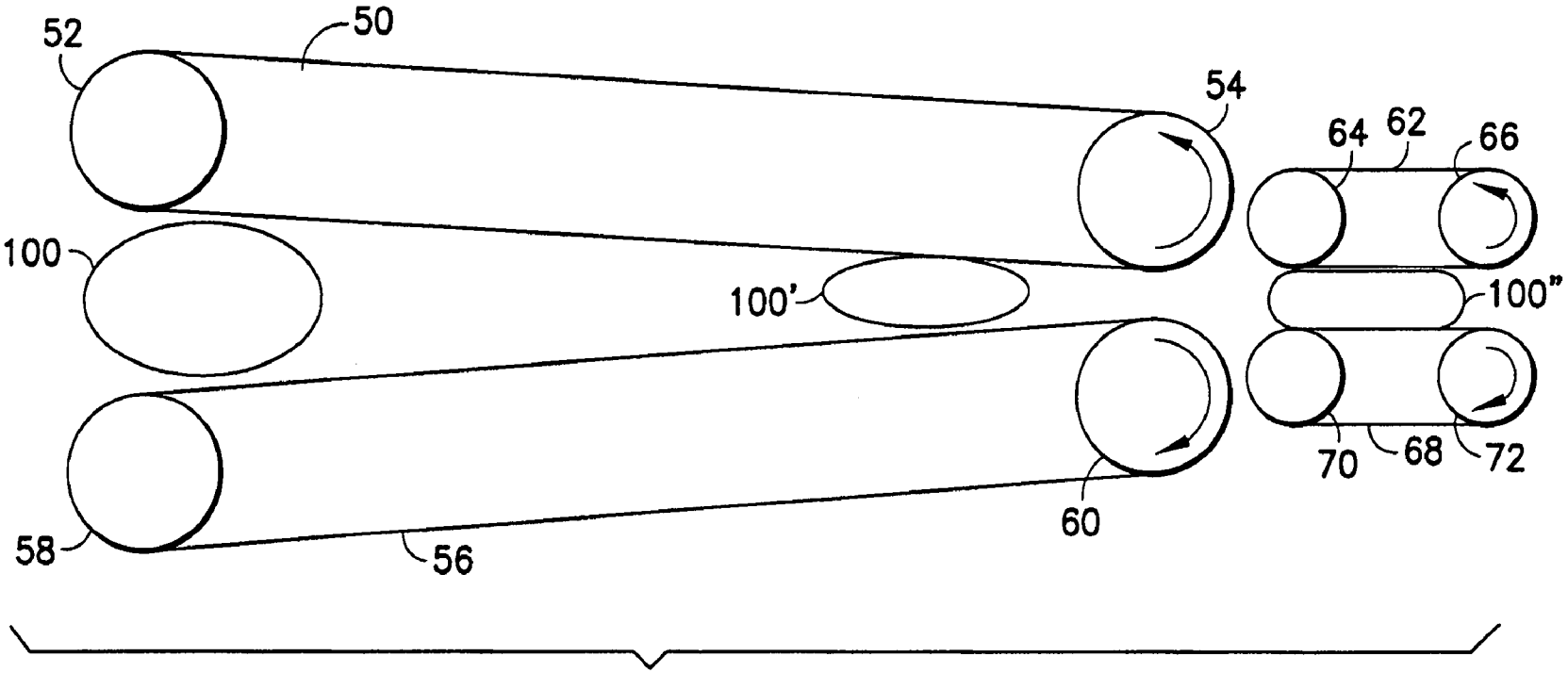
FIG. 3 is a drawing showing a side view of an apparatus for squeezing air out of vented bags filled with particulate matter and then closing the vents.

FIG. 3 shows an exemplary apparatus for squeezing air out of vented bags filled with particulate matter and then closing the vents after air removal. The apparatus for squeezing air out of a package comprises an upper endless tractor belt 50 that circulates on rollers 52 and 54, and a lower endless tractor belt 56 that circulates on rollers 58 and 60. As indicated by arrows on rollers 54 and 60, the belts 50 and 56 circulate in opposite directions, conveying each filled package 100 from left to right in the drawing. The respective portions of the upper and lower tractor belts 50 and 56 that contact the filled packages converge, so that as the filled package is conveyed from left to right in FIG. 3, the contacting portions of belts 50 and 56 squeeze the package. As previously described, the package is provided with one or more vent holes, so that when the filled package is squeezed (as indicated in FIG. 3 by package 100'), excess air inside the package escapes via the vent holes, which are covered by venting material (incorporated in either or both of the tractor belts 50 and 56) that prevents the escape of particulate matter from the package. The squeezing section is followed by a hole sealing section comprising a band sealer in the form of opposing heat-resistant belts (made, e.g., of Teflon®) 62 and 68. Belt 62 circulates on rollers 64 and 66, while belt 68 circulates on rollers 70 and 72. As indicated by arrows on rollers 66 and 72, the belts 62 and 68 circulate in opposite directions as each sealed package 100" is conveyed from left to right in FIG. 3.

Although not shown in FIG. 3, the hole sealing section in accordance with this embodiment further comprises a pair of opposing heated sealing bars that are laterally displaceable between respective extended and retracted positions. Sealing of the walls of the package in the area of vent holes occurs while the sealing bars are in their respective extended positions. The sealing bars are retracted as needed, e.g., during threading of the web and tape through the sealing apparatus prior to startup. Although not shown in FIG. 3, each sealing bar may be mounted to a laterally displaceable seal bar mounting plate via a pair of threaded rods, while the seal bar mounting plate is in turn fastened to the ends of a pair of guide shafts respectively supported by a pair of flanged mount bearings. The flanged mount bearings sit atop and are fastened to a cylinder mounting plate. The force for displacing the sealing bar is provided by an air cylinder having a piston, the end of which is fastened to the middle of the seal bar mounting plate. The sealing is accomplished by electrically heating the sealing bars, the heat being conducted through respective endless heat-resistant belts 62 and 68. The package is sandwiched between and held together by the heat-resistant belts, which move with the package and prevent the packaging film from sticking against the stationary heated sealing bars during conduction heat sealing.

The hole sealing station could be a band sealer (as described above) for sealing a line of vent holes, or a set of reciprocating sealing bars for sealing a smaller area of the packaging film. Alternatively the hole sealing station could add a patch of material to seal the hole, the patch could be heat sealed over the hole or the patch could be a self-adhesive sticker, or piece of tape.

Figure 4:
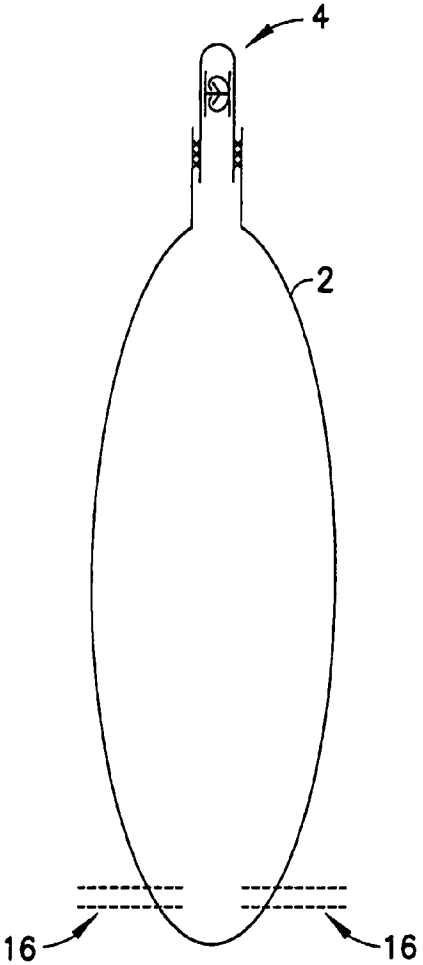

FIGS. 4 through 8 show various stages in a method of manufacture in accordance with another embodiment of the invention. The bag shown in FIGS. 4-8 can be made on the VFFS machine depicted in FIG. 9. The drawings show a "zipper tape" style zipper (previously described), but any type of hermetic reclosure could work, including a slider-operated zipper or a press-to-close zipper attached below a sealed header. As seen in FIG. 4, vent holes 16 are punched in the bag. Each pair of dashed lines in FIG. 4 represents one vent hole 16 in a respective row of vent holes on each side of the bag, each row extending into the page. The location, size and number of holes can be varied. One large hole in a bottom corner may work as well as multiple rows of smaller holes. Alternatively, the bag film could have the holes pre-punched. Hole type could vary from needle holes that do not remove material, to slits, to C-cuts that leave the cut-out attached, to round punches that remove material, to cutting off a corner of the bag.

In the next stage of manufacture (shown in FIG. 5), a loop of the portion of the bag making film that is vented is pressed on both sides by respective strips 18 and 20 of venting material. The venting material is a material such as cloth, screen foam, etc. that allows air to pass through. The venting material covers the venting hole(s) 16. In this example, the two strips 18, 20 of venting material are supported by a structure (not shown) that itself is attached to a reciprocating mechanism (also not shown). While the reciprocating mechanism is in its extended state, the strips 18, 20 of venting material cover the respective rows of vent hole(s) 16 on each side of the bag. Still referring to FIG. 5, the apparatus further comprises a pair of mutually opposing sealing bars 22, 24, at least one of which is heated. These sealing bars may be arranged near and parallel to the strips 18, 20 of venting material. The sealing bars are supported by a separate reciprocating mechanism (not shown) and move independently of the venting material.

While the vented loop of bag making film is disposed between the opposing venting strips 18, 20, the pocket adjacent the loop is filled with particulate or other matter (not shown in FIG. 5) by means of a fill tube disposed at an elevation higher than the elevation of the venting material. Having the venting material collapse the loop as much as possible could help minimize product from contaminating the area around the vent hole(s) that will be sealed in a later step.

Figure 6:
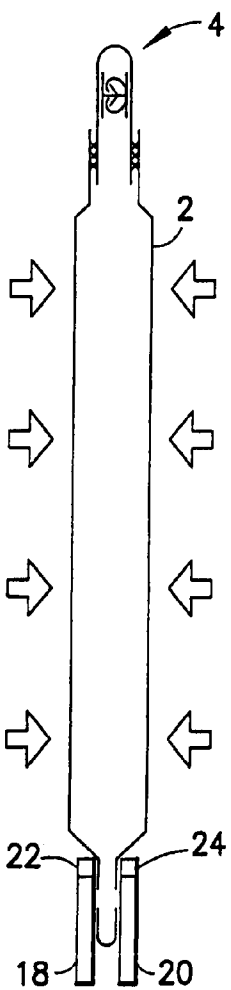
FIGS. 4 through 7 are drawings showing respective sectional views of various stages in a method of manufacture in accordance with another embodiment of the invention.
Figure 5:
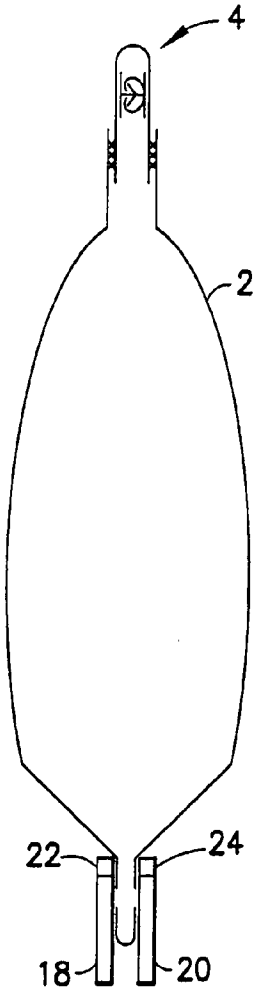

Thereafter, air is squeezed out of the package, as indicated by the mutually opposing sets of arrows in FIG. 6. This can be accomplished by extending a pair of reciprocating plates or screens that push the sides of the bag toward each other, thereby forcing air out of the bag via the vent holes covered by venting material 18, 20. The venting material is not permeable to the particulate matter that the bag is filled with, which reduces the loss of product during squeezing. While in the squeezed state, with excess air removed from inside the bag, the interior (filled with product) volume of the bag is then sealed off from the vent holes by extending the reciprocating sealing bars 22, 24, which form a seal 26 (see FIG. 7). Alternatively, an impulse seal or a band sealer could be used to make seal 26. An impulse seal is typically made by passing a current through a thin Nichrome wire that causes the wire to heat up almost instantaneously; the current is then turned off, allowing the wire to cool. This cycle occurs for each bag/packaging machine index. This is in contrast to the more typical steady-state seal bar that is heated to a specific temperature and the control system tries to maintain that temperature while packages are being made.

Figure 8:
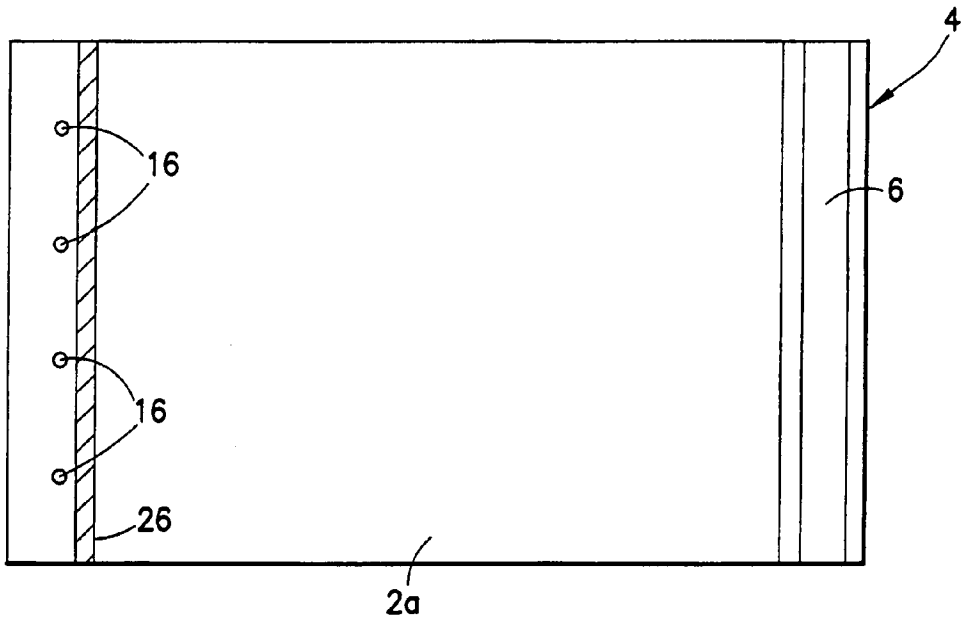
FIG. 8 is a drawing showing a front view of a finished bag following completion of the manufacturing steps depicted in FIGS. 4-7.

As best seen in FIG. 8, the vent holes are sealed off from the product-filled pocket by sealing the front bag panel to the rear bag panel along a band- or strip-shaped zone 26 that extends across the full width of the package. In accordance with a further alternative, a respective patch could be used to seal each hole. The patch could be heat sealed or a self-adhesive "sticker". Alternatively, a piece of tape could be used to cover a row of vent holes. Once the vent holes are sealed, no further air can be removed from the bag, and no ambient air can enter the bag via the sealed vent holes. FIG. 8 shows a front view of a finished bag that has a line of vent holes 16, and that has the front and rear bag panels sealed together in zone 26 across the full width of the bag.

Figure 9:
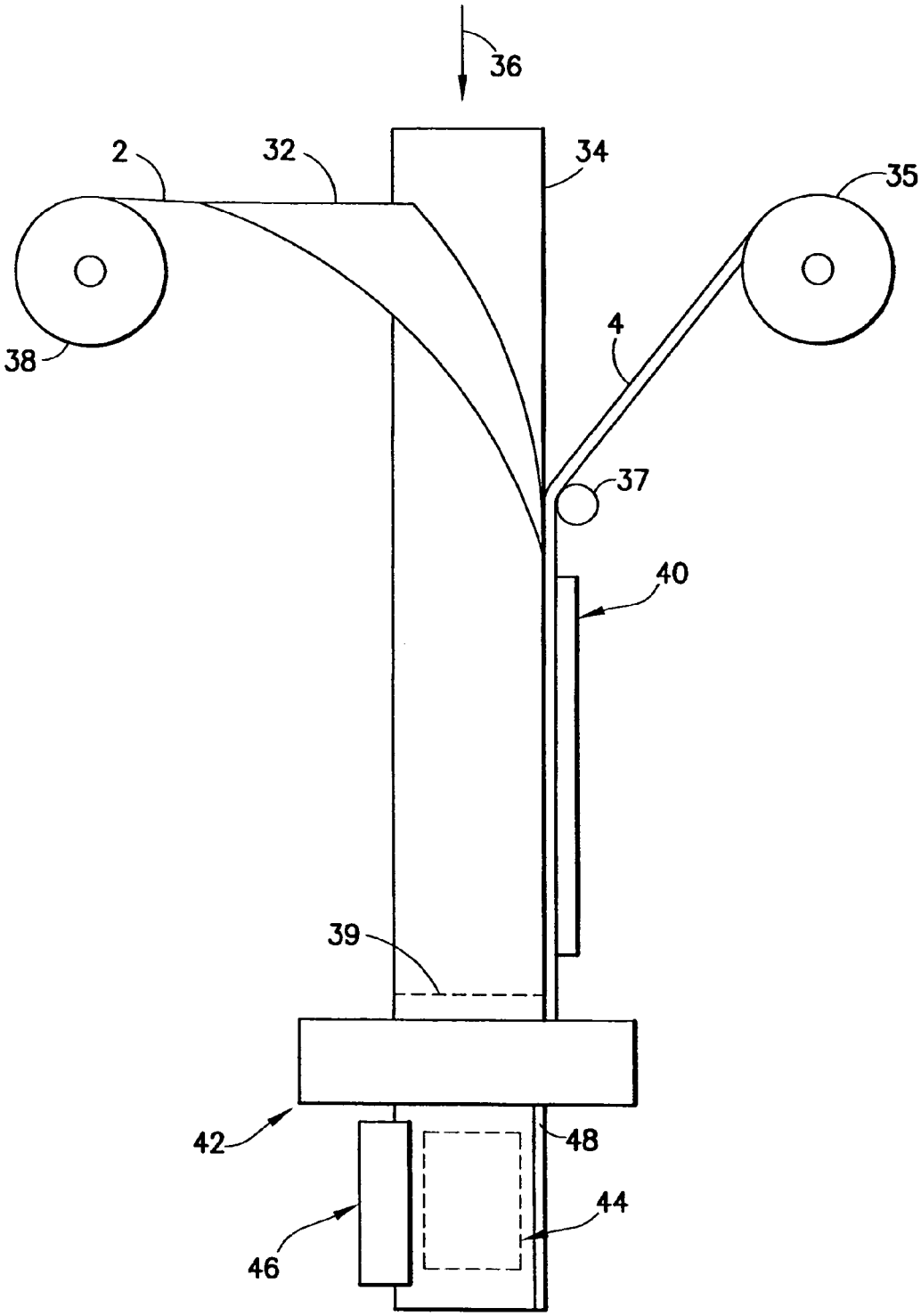
FIG. 9 is a drawing showing an elevational view of a VFFS machine designed to make bags in accordance with the method depicted in FIGS. 4-7. Some of the components (e.g., items 42 and 46) are represented by blocks without any visual indications of the component's construction and shape.

Application of the method of FIGS. 4-8 to a VFFS machine is generally represented in FIG. 9. In accordance with one embodiment of the invention, a web 2 of packaging film is fed from a continuous supply roll 38, passed over a forming collar 32 and wrapped around a fill tube 34 to bring the mutually parallel edges of the film web 2 together to form a tube of film. The film passes through a gap between the forming collar 32 and the top of the fill tube 34 in a well-known manner. The marginal portions of the web 2 do not lie against the outer surface of the fill tube, and instead are guided into mutually confronting vertical positions by guiding means (not shown). The fill tube has an upper funnel end through which product is discharged to fall downwardly (as indicated by arrow 36 in FIG. 9) into individual packages. At the same time that the film web 2 is being fed, a zipper tape 4 is fed from a continuous coil on a supply reel or spool 35 and redirected by a guide roller 37. The zipper tape is guided downwardly by a guide member in the form of a separator plate (not shown in FIG. 9) disposed between the mutually confronting marginal portions (i.e., fins) of the film web 2 in the manner previously described (see earlier discussion of a typical VFFS machine). Within the zone of overlap, opposing portions of the zipper tape web are joined to opposing portions of the fins of web 2 in respective band-shaped zones of joinder (items 12 and 14 shown in FIG. 1) when a pair of vertical sealing bars 40 (only one of which is visible in FIG. 9) are heated and moved to their extended positions. The film can be advanced (downwardly) by any conventional means, such as drive belts that bear against the film wrapped around the fill tube.

In the VFFS machine shown in FIG. 9, filling the interior of the bag, squeezing the bag, and sealing the vent holes are all performed while the bag precursor (i.e., the pocket formed by the cross-sealed film tube) is in the same position, just below the cross-seal jaws and bag cut-off (i.e., the fill position). The block labeled 42 in FIG. 9 represents two pairs of mutually opposing horizontal sealing bars with a cutting instrument arranged between the respective pairs of sealing bars. The cross-sealing bars are first brought together against a portion of the tubular film at a location where the film portion has descended below the lower end 39 of the fill tube 34 in order to form a pair of cross seals that join mutually opposing band-shaped portions of the film. One cross seal closes an already filled pocket, while the other cross seal forms the bottom of the next pocket, so that as product is dropped through the fill tube 34, that product is retained within the latter pocket. Essentially simultaneously with cross sealing by the sealing bars, the cutting instrument, e.g., a knife, is moved across the film (at an elevation between the spaced-apart cross seals) to sever an individual previously filled package from the work in process.

Figure 7:
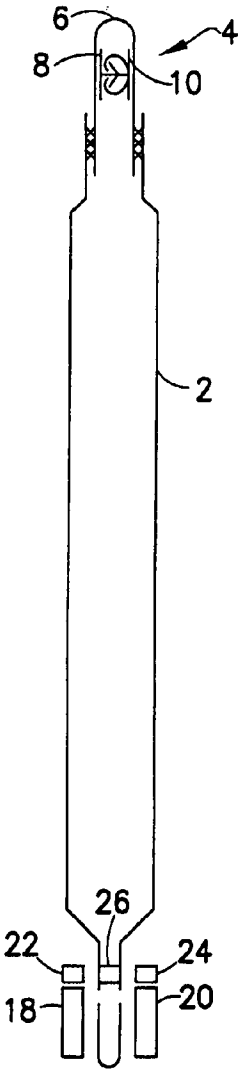

The block labeled 46 in FIG. 9 represents a combination venter/sealer, which may comprise the previously described pieces of venting material (items 18, 20 in FIG. 7) and vertical sealing bars (items 22, 24 in FIG. 7). As previously described, before the bag is filled with product, a loop is formed in the film tube 2 and the venting material is brought into contact with opposite sides of the loop and overlapping the vent holes. The bag is filled while the venter is closed. After the bag has been filled with product, the cross seals are formed as described in the preceding paragraph. Then the bag is squeezed by a squeezer 44 (one side of which is indicated by the dotted rectangle in FIG. 9), forcing air out through the vent holes. Then the vent holes are sealed off from the rest of the bag by a heat seal formed when the vertical sealing bars (part of block 46) are extended. The finished package is then cut off by the cutting instrument of mechanism 42.

All of the operations performed by the VFFS machine, including advancement of the bag making film, are controlled by a programmed logic controller (not shown).

Figure 10:
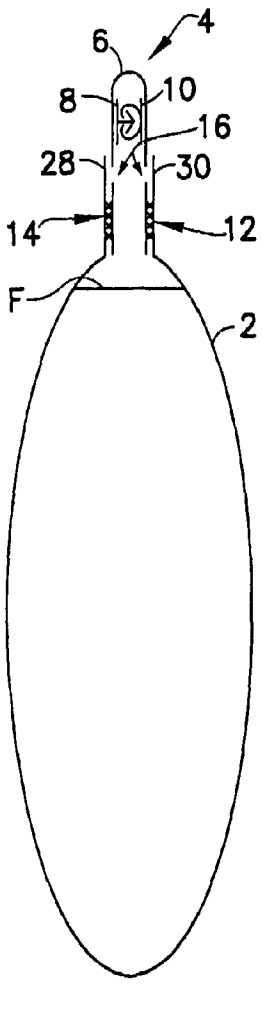
FIG. 10 is a drawing showing a sectional view of a bag having pre-made vent holes in a zipper flange in accordance with a third embodiment of the invention.

In accordance with a further embodiment of the invention shown in FIG. 10, the vent holes 16 are formed in the base web 6 of a zipper tape 4 instead of in the bag making film. The vent holes 16 are disposed at an elevation above the product fill line F and above the permanent heat seals 12, 14. As was the case in the embodiment seen in FIG. 9, a row of spaced vent holes may be formed on each side of the zipper tape. Preferably, these vent holes are formed in the zipper tape before the zipper tape is joined to the web of bag making film. For the purpose of illustration, this method of manufacture will be disclosed in the context of an HFVF machine.

FIG. 10 shows a bag precursor (i.e., one pocket formed by folding and then cross sealing) that has already been filled vertically, e.g., by leaving one side of the zipper tape unattached to a bag wall and dropping product into the pocket through an opening between the unattached bag wall and zipper tape. After the pocket is filled, the unattached side of the zipper tape is joined to the unattached bag wall.

Figure 12:
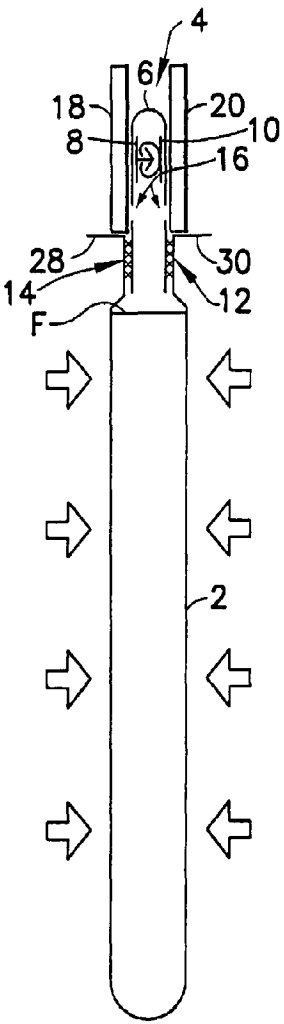
Figure 11:
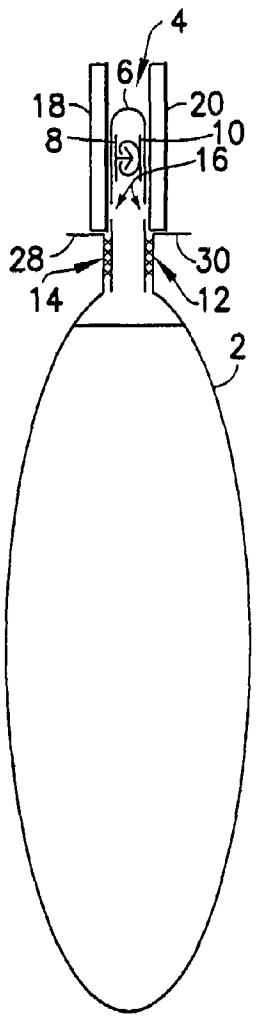

As seen in FIG. 10, in the filled package the zipper tape 4 is attached to the opposing walls of the bag by respective permanent seals 12, 14, with marginal portions of the bag walls being free to form respective bag flanges 28, 30 that overlap the vent holes 16 in the zipper tape. In the next stage of manufacture depicted in FIG. 11, the two bag flanges 28, 30 are folded outward and away from the vent holes to expose the latter. Then two strips 18, 20 of venting material are placed against the respective vented sides of the zipper tape, i.e., the venting material covers the vent holes in the zipper, allowing air to escape but blocking the exodus of particulate matter. Then the bag is squeezed as indicated by the mutually opposing sets of arrows in FIG. 12. This causes air to vent out of the bag via the vent holes 16 and the venting material 18, 20.

Figure 13:
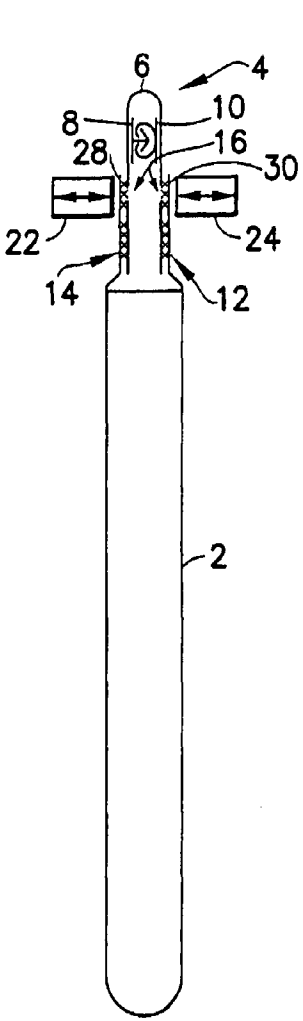
FIGS. 11 through 13 are drawings showing respective sectional views of the bag shown in FIG. 10 at various stages of a method of manufacture in accordance with the third embodiment of the invention.

Referring now to FIG. 13, while the bag is in its fully squeezed state, the spread bag flanges 28, 30 are returned to their original positions overlying the vent holes 16. In these positions, the bag flanges are then joined to the respective sides of the zipper tape web 6 by means of a pair of reciprocating horizontal heated sealing bars 22 and 24. In this implementation, the vent hole seals are formed in a zone that overlaps the vent holes, causing the peripheries of the vent holes to be joined to the bag flanges. This has the effect of sealing the vent holes 16 closed, thereby eliminating the need for a separate patch material. The work in process is then cut along a transverse line to sever the finished package from the remainder of the work in process.

Figure 14:
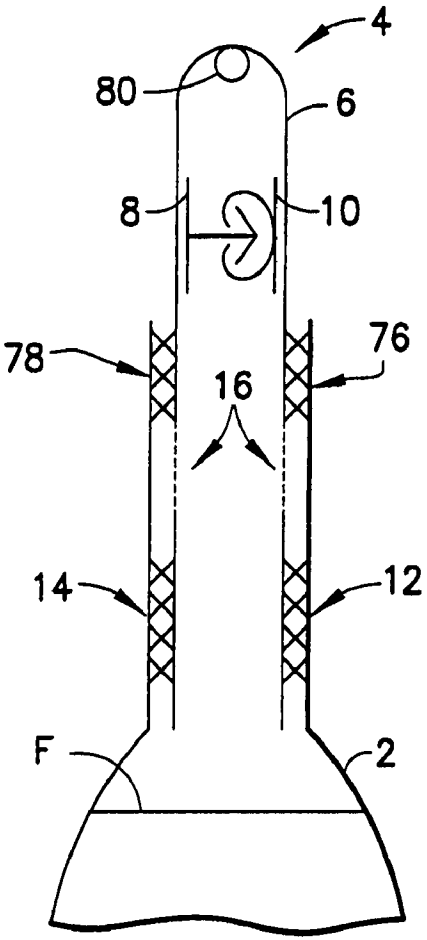
FIG. 14 is a drawing showing a sectional view of a zipper tape attached to a top of a bag from which air has been exhausted in accordance with a variation of the method of manufacture shown in FIGS. 11-13.

FIG. 14 shows a sectional view of a zipper tape 4 attached to a top of a bag 2 from which air has been exhausted in accordance with a variation of the method of manufacture shown in FIGS. 10-13. In this implementation, the vent hole seals 16 are again formed by sealing respective bag flanges to the zipper tape web, but in this case, at an elevation above the elevation of the vent holes and at bag flange cross seals (not shown in FIG. 14). The bag flange/zipper tape seals are designated by numerals 76 and 78 in FIG. 14. The combination of the bag flange/zipper tape seals 76, 78 and the bag flange cross seals (which are basically extensions of the bag cross seals (not shown in FIG. 14) hermetically seal the header interior volume under the zipper tape web 6. To facilitate opening of the package (to provide access to the zipper 8, 10), the zipper tape 4 may be provided with a tear bead 80 and tear lines (not shown in FIG. 14) on respective sides of the tear bead.

Figure 15:
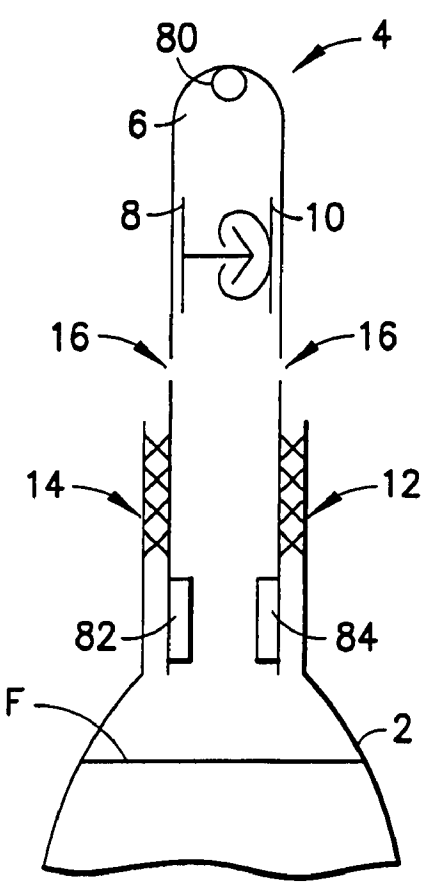
FIG. 15 is a drawing showing a sectional view of a vented zipper tape attached to a top of a bag and provided with layers of material for forming a peel seal after air removal in accordance with a further embodiment of the invention.

Lastly, FIG. 15 shows a sectional view of a vented zipper tape 4 attached to a top of a bag 2 and provided with layers 82, 84 of peel seal material for forming a peel seal after air removal in accordance with a further embodiment of the invention. These layers of peel seal material may be applied as a coating on the respective inside surfaces of the marginal portions of the zipper tape web 6. The vent holes 16 are formed in the zipper tape web 6 at an elevation above the elevation of the peel seal material and above the elevation of the permanent seals 12, 14. After excess air has been expelled from the package, the peel seal is activated in a conventional manner, e.g., by application of heat and pressure using mutually opposed heated sealing bars. As a result of peel seal activation, the respective layers 82, 84 of peel seal material are brought into contact and joined together (not shown in FIG. 15) to hermetically seal the interior volume of the package.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. Also, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) making a package having an opening and a first vent hole;

(b) loading product into said package via said opening;

(c) closing said opening;

(d) placing a first layer of air-permeable material in contact with an external surface of said package in a position in which a portion of said first layer of air-permeable material overlies said first vent hole;

(e) applying external pressure on said package after steps (a) through (d) have been performed to force air out said first vent hole, said external pressure being applied by mechanical structures that contact said package; and (f) after step (e) has been performed, sealing said package so that air can neither enter nor exit an interior volume of said package via said first vent hole, said interior volume being filled with said product.

2. The method as recited in claim 1, wherein said sealing step comprises sealing said package along a line that passes between the first vent hole and said product.

3. The method as recited in claim 2, wherein said sealing step comprises activating a layer of peel seal material.

4. The method as recited in claim 1, wherein said sealing step comprises sealing along a perimeter of said first vent hole.

5. The method as recited in claim 1, wherein said sealing step comprises covering said first vent hole with an air-impermeable patch.

6. The method as recited in claim 1, wherein said first vent hole is a slit.

7. The method as recited in claim 1, wherein said first vent hole is formed without removing material.

8. The method as recited in claim 1, wherein said first vent hole is a C-cut that leaves the cutout attached.

9. The method as recited in claim 1, wherein said first vent hole is an aperture.

10. The method as recited in claim 1, wherein said making step comprises the steps of forming and sealing a web of packaging material to form a receptacle, said first vent hole being pre-made in said web before said receptacle is formed.

11. The method as recited in claim 1, further comprising the step of making a second vent hole in said package, wherein said first layer of air-permeable material also overlies said second vent hole.

12. The method as recited in claim 1, further comprising the steps of making a second vent hole in said package and placing a second layer of air-permeable material over said second vent hole.

13. The method as recited in claim 12, wherein a portion of said package is sandwiched between said first and second layers of air-permeable material during said squeezing step.

14. The method as recited in claim 1, wherein the package comprises a receptacle having said opening and a closure for closing said opening, said first vent hole being made in said closure.

15. The method as recited in claim 14, wherein said sealing step comprises covering said first vent hole with a flange portion of said receptacle.

16. The method as recited in claim 1, wherein the package comprises a receptacle and a closure for closing said opening in said package, said first vent hole being made in said receptacle.

17. A VFFS machine comprising the following components disposed below an elevation where each filled package in sequence is severed from the remaining packages in process:

a bag squeezer comprising first and second mechanical structures arranged on opposite sides of an unfinished bag disposed therebetween and below said elevation, said first mechanical structure comprising a piece of air-permeable material, wherein during operation of said bag squeezer, said first and second mechanical structures squeeze said unfinished bag while said piece of air-permeable material overlies a vent hole formed in said unfinished bag.

18. The VFFS machine as recited in claim 17, further comprising a reciprocating mechanism that supports said piece of venting material.

19. The VFFS machine as recited in claim 17, further comprising a pair of mutually opposed vertical sealing bars disposed below the bag cut-off elevation.

20. A method of manufacture comprising the following steps:

(a) forming a receptacle;

(b) forming a vent hole in a wall of said receptacle;

(c) placing a layer of air-permeable material in contact with an external surface of said package in a position in which a portion of said first layer of air-permeable material overlies said vent hole;

(d) filling said receptacle with product via an opening;

(e) closing said opening after filling;

(f) after said opening has been closed, applying external pressure on said receptacle to force air out said vent hole, said external pressure being applied by opposing mechanical structures that contact said receptacle; and (g) sealing said vent hole after step (e) has been performed so that air can neither enter nor exit said receptacle via said vent hole.

21. The method as recited in claim 20, wherein said vent hole has a perimeter and said sealing step comprises sealing said vent hole around its perimeter.

22. The method as recited in claim 20, wherein said sealing step comprises covering said vent hole with an air-impermeable patch.

23. A method of manufacture comprising the following steps:

(a) forming a vent hole in a zipper tape;

(b) joining a first portion of said zipper tape to a first portion of a web of packaging material;

(c) joining a second portion of said zipper tape to a second portion of said web;

(d) joining third and fourth portions of said web to each other along a first line transverse to said zipper tape;

(e) joining fifth and sixth portions of said web to each other along a second line transverse to said zipper tape;

(f) placing a layer of air-permeable material in contact with an external surface of said package in a position in which a portion of said layer of air-permeable material overlies said first vent hole;

(g) filling a receptacle with product via an opening either after steps (d) and (e) but not step (c) have been performed or after steps (c) and (d) but not step (e) have been performed, said receptacle having respective walls formed by said first and second portions of said web and being in fluid communication with said vent hole;

(h) after steps (a) through (g) have been performed, applying external pressure on said receptacle to force air out said vent hole, said external pressure being applied by mechanical structures that contact said package; and (i) sealing said vent hole after squeezing so that air can neither enter nor exit said receptacle via said vent hole.

24. The method as recited in claim 23, wherein said sealing step comprises covering said vent hole with an air-impermeable patch.

25. The method as recited in claim 23, wherein said sealing step comprises joining a seventh portion of said web to said zipper tape.

26. A method for expelling air from an interior volume of a flexible package, comprising the following steps:

(a) forming a package having an open mouth and having a vent hole in an area above an elevation corresponding to a product fill level;

(b) filling said open package with product up to said elevation via said open mouth;

(c) sealing said mouth closed;

(d) after steps (a) through (c) have been performed, applying external pressure on said package to expel air from an interior volume of said package via said vent hole, said external pressure being applied by mechanical structures that contact said package; and (e) sealing said vent hole from said interior volume so that air can neither enter nor exit said interior volume via said vent hole.

* * * * *